US008083081B2

(12) United States Patent
Coley, Jr. et al.

(10) Patent No.: US 8,083,081 B2
(45) Date of Patent: Dec. 27, 2011

(54) BOTTLE WITH REINFORCED TOP PORTION

(75) Inventors: Ralph T. Coley, Jr., Cohasset, MA (US); Masaaki Sasaki, Matsudo (JP); Takao Iizuka, Koto-ku (JP)

(73) Assignees: Ocean Spray Cranberries, Inc., Lakeville-Middleboro, MA (US); Yoshino Kogyosho Co., Ltd., Tokyo (JP)

( * ) Notice: Subject to any disclaimer, the term of this patent is extended or adjusted under 35 U.S.C. 154(b) by 1222 days.

(21) Appl. No.: 11/384,828

(22) Filed: Mar. 21, 2006

(65) Prior Publication Data

US 2006/0207962 A1 Sep. 21, 2006

Related U.S. Application Data

(60) Provisional application No. 60/663,211, filed on Mar. 21, 2005.

(51) Int. Cl.
*B65D 1/02* (2006.01)
*B65D 1/42* (2006.01)
*B65D 23/10* (2006.01)

(52) U.S. Cl. ..... 215/384; 215/381; 215/398

(58) Field of Classification Search ..... 215/382–384, 215/398; 220/671, 675, 669, 670
See application file for complete search history.

(56) References Cited

U.S. PATENT DOCUMENTS

| | | | | |
|---|---|---|---|---|
| D22,058 | S | | 12/1892 | Rockwood |
| D58,077 | S | | 6/1921 | Eckl |
| D62,784 | S | | 7/1923 | Marble |
| D64,125 | S | | 12/1923 | Miller |
| D68,732 | S | | 11/1925 | Root |
| D315,678 | S | | 3/1991 | Darr |
| D346,556 | S | | 5/1994 | Sirico et al. |
| D378,353 | S | * | 3/1997 | Emre et al. ..... D9/542 |
| 5,758,790 | A | | 6/1998 | Ewing, Jr. |
| 5,848,516 | A | * | 12/1998 | Ban ..... 53/453 |
| 5,908,127 | A | * | 6/1999 | Weick et al. ..... 215/373 |
| 6,016,932 | A | * | 1/2000 | Gaydosh et al. ..... 215/382 |
| 6,029,837 | A | * | 2/2000 | Slat et al. ..... 215/384 |
| 6,095,360 | A | * | 8/2000 | Shmagin et al. ..... 215/382 |
| 6,161,713 | A | * | 12/2000 | Krich ..... 215/384 |
| 6,213,326 | B1 | | 4/2001 | Denner et al. |

(Continued)

FOREIGN PATENT DOCUMENTS

JP 565158 * 3/1993

(Continued)

OTHER PUBLICATIONS

Coley, Jr. et al., U.S. Appl. No. 29/234,372, filed Jul. 2005.

*Primary Examiner* — Sue Weaver

(74) *Attorney, Agent, or Firm* — Nixon & Vanderhye P.C.

(57) ABSTRACT

A bottle includes a top portion and a bottom portion. The top portion includes a shoulder that extends away from a neck of the bottle, and a grip portion. The grip portion is recessed within the top portion of the bottle. The top portion of the bottle includes at least one strengthening element, preferably in the form of a rib or column that may be provided between the upper and lower bell portions, or between the upper bell or shoulder portion and the grip portion. The bottle can be used for hot or cold fill applications.

28 Claims, 6 Drawing Sheets

U.S. PATENT DOCUMENTS

| | | | | |
|---|---|---|---|---|
| 6,264,053 | B1 * | 7/2001 | Slat | 215/384 |
| 6,467,639 | B2 * | 10/2002 | Mooney | 215/384 |
| 6,575,321 | B2 | 6/2003 | Bourque et al. | |
| 6,662,961 | B2 * | 12/2003 | Yourist | 215/382 |
| 6,749,075 | B2 | 6/2004 | Bourque et al. | |
| D503,627 | S | 4/2005 | Johnston et al. | |
| 6,981,604 | B2 * | 1/2006 | Iizuka et al. | 215/381 |
| 7,004,342 | B2 | 2/2006 | Bourque et al. | |
| 2001/0037992 | A1 | 11/2001 | Tanabe et al. | |
| 2003/0161980 | A1 * | 8/2003 | Nelson | 428/36.7 |
| 2003/0205550 | A1 * | 11/2003 | Prevot et al. | 215/384 |
| 2004/0129669 | A1 | 7/2004 | Kelley et al. | |
| 2005/0218107 | A1 * | 10/2005 | Sabold et al. | 215/382 |

FOREIGN PATENT DOCUMENTS

WO WO 2004/094261 A1 * 11/2004

* cited by examiner

BOTTLE WITH REINFORCED TOP PORTION

CROSS-REFERENCES TO RELATED APPLICATIONS

This application claims the benefit of U.S. Provisional application No. 60/663,211, filed Mar. 21, 2005, incorporated herein by reference in its entirety.

STATEMENT REGARDING FEDERALLY SPONSORED RESEARCH OR DEVELOPMENT

None.

BACKGROUND OF THE INVENTION

FIG. 1 shows a prior art bottle having a generally rectangular configuration. This bottle is the subject of U.S. Pat. Nos. 6,575,321 and 6,749,075, each incorporated herein by reference in its entirety. While that bottle has enjoyed commercial success and very satisfactorily performs its intended functions, there is an ever growing need to improve such bottles, and to reduce the cost for shipping such bottles.

For example, the bottle shown in FIG. 1 is typically shipped from a beverage packer, e.g., cranberry juice, to the distribution outlets (e.g., grocery store) using conventional cardboard cases each holding eight bottles, and it is not unusual that five cases are stacked one on top of the other for a total of 40 bottles. In this case, the lowermost layer of eight bottles supports the weight of the remaining 32 bottles, each 64 oz. bottle weighing about four lbs, or 32 bottles×4 lbs each=128 lbs. When the cases are stacked as such, a corrugate (formed from the top of a lower case and the adjacent bottom of an upper case) is provided between each layer, for added load bearing, as each bottle has a top loading capacity of about 45 lbs.

In addition, the top portion of the bottle shown in FIG. 1 is designed to receive an auxiliary (adhesive) label in the grip area, as described in U.S. Pat. Nos. 6,575,321 and 6,749,075. The label is applied during of after the bottling process in which the bottle is held firmly by the top and bottom ends. Because the contained beverage is pasteurized, the side walls of the container are subject to vacuum deformation which in part is dealt with by providing the bottle with vacuum accommodating sections such as vacuum panels on the bottom portion of the container, or auxiliary vacuum deformation portions that may be located in the grip portion, the base portion and/or other portions of the bottle. Any vacuum deformation in the top part of the bottle where the label is to be applied can compromise the positioning and/or registration of the label.

U.S. Patent Publication No. US 2001/0037992 discloses a bottle with reinforcing ribs around the bottle waist. However, that bottle does not relate to a rectangular bottle or ones where reinforcement is placed at the top portion of the bottle, e.g., where the shoulder and/or bell structure is located.

Thus, a need has developed in the bottling art to provide address one or more of these challenges.

BRIEF SUMMARY OF THE INVENTION

One aspect of the present invention relates to a bottle having a reinforced top portion, e.g., on a rectangular bottle.

Another aspect relates to reducing the amount of corrugate cardboard casing used to ship containers, e.g., by eliminating the top cover of the case.

Another aspect of the present invention relates to a hot-fillable or cold-fillable plastic bottle, comprising a body portion having a top portion and a bottom portion, the top portion including a shoulder, a grip portion below the shoulder and at least one protruding reinforcing element positioned between the shoulder and the grip portion.

In exemplary embodiments, the reinforcing element comprises a column. The column may have a length and a narrow middle section that tapers to relatively wider upper and/or lower portions, the length is about 0.5 to 1.2 inches (about 12 to 30 mm), the narrow middle section has a width of about 0.3 to 0.8 inches (about 7.5 to 20 mm), and the upper and/or lower portions have a width of about 0.6 to 1.1 inches (about 15 to 28 mm), .e.g., the length is about 0.710 inches (about 18 mm), the width of the narrow section is about 0.585 inches (about 15 mm), and the width of the upper and/or lower portions is about 0.875 inches (about 22 mm). The column may protrude away from the top portion in the range of about 0.010 to 0.250 inches (about 0.25 to 6.4 mm), e.g., the protrusion depth is about 0.080 inches (about 2 mm).

The top portion may be generally polygonal shaped and the top portion of the bottle may include one said column centered on each side of the top portion. The top portion may include one said column provided on each corner of the top portion. The bottle may be generally square or rectangular.

The top portion may includes a bell section including an upper bell portion generally coincident with the shoulder and a lower bell portion, the upper and lower bell portions defining a valley therebetween, the column extending across at least a portion of the valley from the upper bell portion to the lower bell portion. Otherwise, the column may extend between the grip portion and the shoulder or upper bell portion.

These and other aspects will be described in or apparent from the following description of preferred embodiments.

DETAILED DESCRIPTION OF PREFERRED EMBODIMENTS

Figure 1:
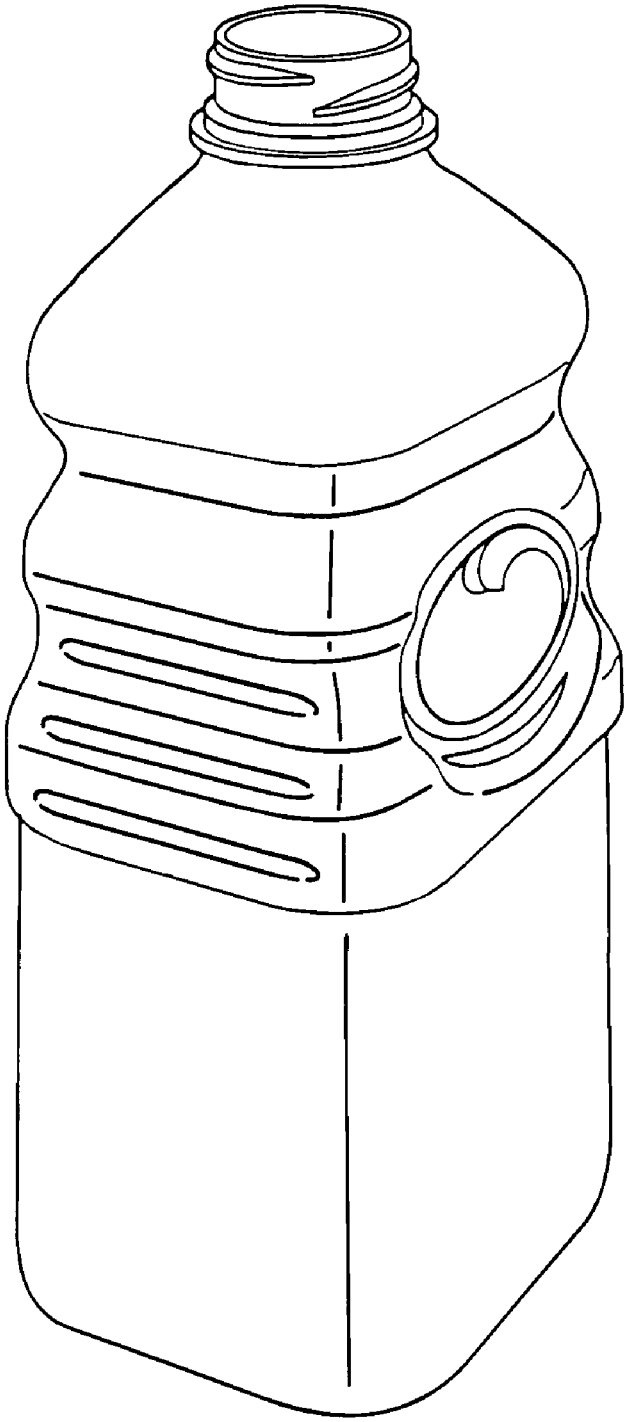
Fig. 1 (Prior Art)
FIG. 1 is a perspective view from the top, front side of a prior art bottle.

FIGS. 2-7 show one preferred embodiment of the present invention. In the figures, reference number 10 designates a plastic container, e.g. a polyethylene terephthalate (PET), hot-fillable or cold-fillable beverage container.

The container 10 includes a neck 30 and a body portion 40 that extends away from the neck 30. The neck 30 may be crystallized to have a substantially opaque appearance, as is well known in the art. However, it is not necessary to provide a crystallized neck. The body portion 40 includes a top portion 45 and a bottom portion 50, which in the exemplary embodiment has a vacuum panel section that is shorter than the top portion 45. A base portion 25 is provided below the vacuum panel section.

The container 10 is manufactured, for example, using a blow-molding process which is well known. During blow-molding, a preform (not shown) is expanded and assumes the shape of an interior molding surface, i.e., a mold (not shown), to form a substantially transparent, biaxially-oriented container. The neck 30 of the preform is not expanded and remains as the neck 30 of the container 10. The neck 30 includes threads and an open mouth 35 for receiving a screw-on cap (not shown). The lower portion of the preform is expanded to form the body portion 40 of the container 10, including the top portion 45 and the bottom portion 50.

Figure 2:
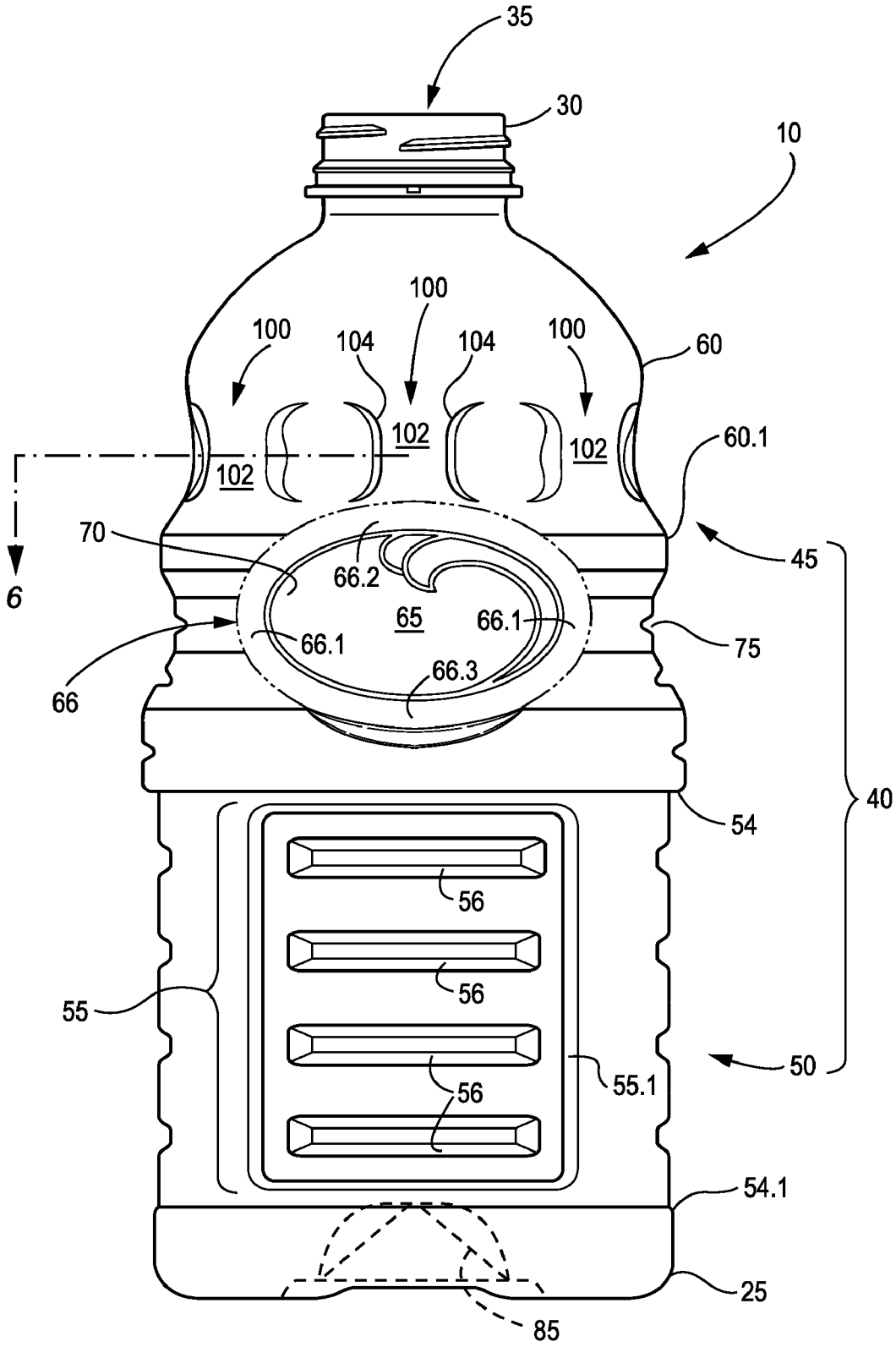
FIG. 2 is a front elevation view of a bottle according to one preferred embodiment of the present invention, the rear view thereof being identical thereto.
Figure 3:
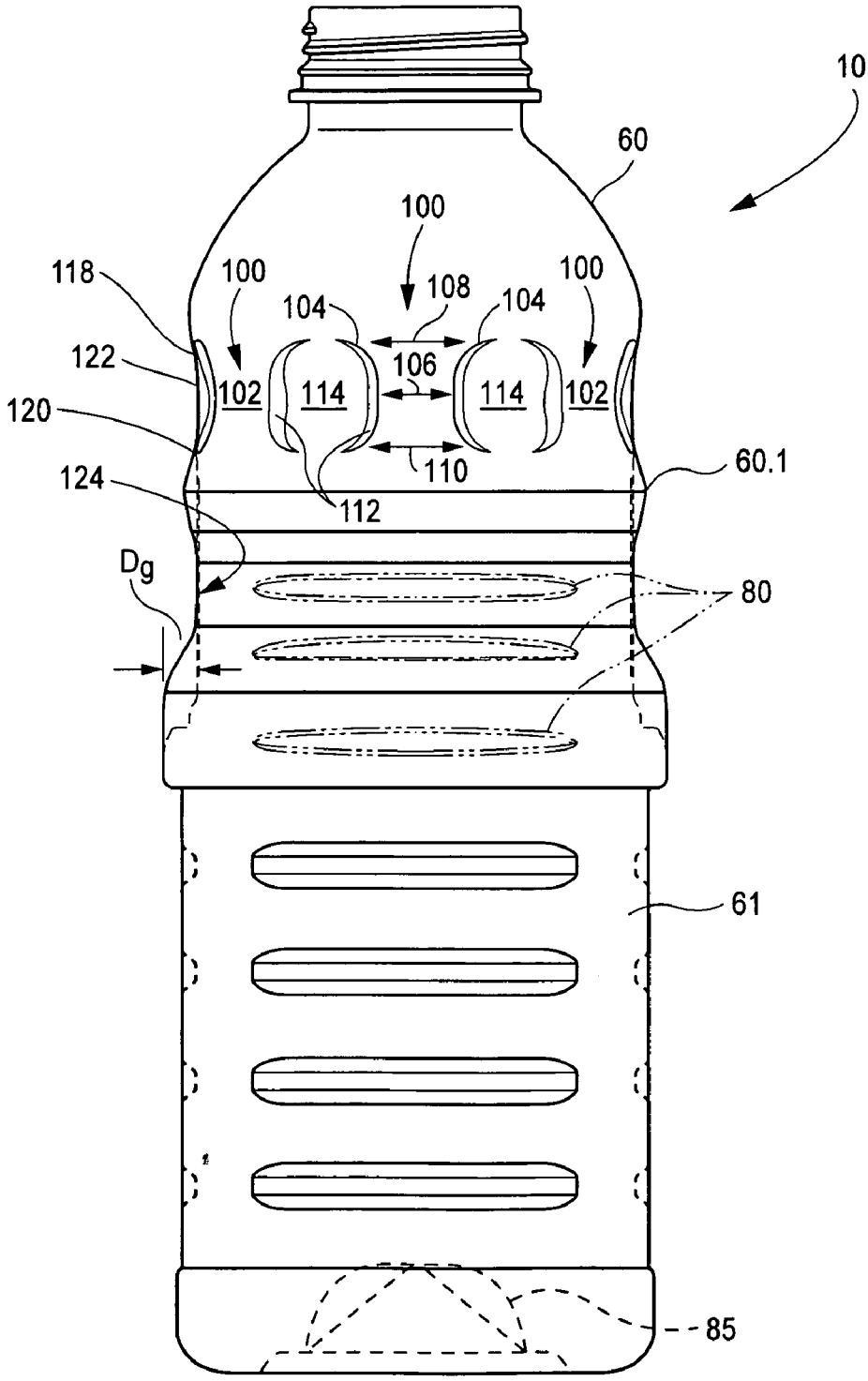
FIG. 3 is a left side view of the bottle shown in FIG. 2, with the opposite view thereof being identical thereto.

The bottom portion 50 of the container 10, as shown in FIGS. 2 and 3, includes a panel section having a plurality of vacuum deformation portions, e.g., in the form of panels 55. Each panel section 55 may be recessed into the bottom portion 1-5 mm or more, which is represented by an increasing depth border 55.1 surrounding each vacuum panel 55.

The base 25 is provided below the vacuum panels 55. For example, each of the longer sides 15 and shorter sides 20 of the container 10 includes a vacuum panel 55. The vacuum panels 55 accommodate internal forces tending to collapse the vacuum panel 55 inwardly due to filling the container 10 with a liquid at an elevated temperature, e.g., a pasteurization temperature. After the container 10 is hot-filled and capped, cooling of the liquid tends to collapse the vacuum panels 55.

While this example relates to hot-fill applications, it is also contemplated that the container 10 can be used in cold-fill applications. For example, the container can be made using an aseptic cold-fill line.

Each vacuum panel 55 may include at least one, e.g., four, lateral stiffening ribs 56 to add rigidity, e.g., to prevent more than a certain amount of deformation of the vacuum panels 55. The vacuum panels 55 on the shorter sides 15 generally accommodate a lesser amount of the internal forces as compared to the vacuum panels on the larger sides 20.

Further, the bottom portion 50 of the container 10 is adapted to receive a label 61 (FIG. 3) which is wrapped, e.g., shrink-wrapped, around the vacuum panels 55. For example, the label 61 (only a portion is shown) wraps about the entire perimeter of the container 10. The label 61 is positioned below a transition shoulder 54 between the top and bottom portions 45, 50 of the body portion 40. A lower transition shoulder 54.1 defines a lowermost boundary of the label 61. The label 61 could include one or more separate parts to be individually applied to only one or more of the longer and shorter sides.

Bottle 10 includes a shoulder 60 and a grip portion 65 provided below shoulder 60. The grip portion 65 is inwardly recessed into the body portion 40. For example, the grip portions 65 on opposite sides of the container 10 are spaced a distance that is less than the width of the top portion of the container. Preferably, each grip portion 65 is recessed a depth Dg which is about 1-20 mm or more, and preferably, about 5-15 mm into the body portion 40, as shown in FIG. 3. In embodiments, the depth Dg may be only a few millimeters, e.g., 1-5 mm. As a result, the border of each grip portion 65 includes a ledge 66 (FIG. 2) that improves gripability. Preferably, the ledge substantially surrounds the entire grip portion 65, although it is possible that less than the entire perimeter of the grip portion 65 includes the ledge. For example, the ledge may be limited to just the lateral (left and right) sides or one lateral or vertical side of the grip portion 65, where the user grips the container 10. The grip portion 65 may have a very shallow depth (e.g. 1-5 mm) on the lateral sides 66.1 and the upper side 66.2, and increased depth (2-7 mm) on the lower side 66.3. Further, although the grip portion 65 is shown as generally oval shaped, it can take the form of other shapes such as circles, diamonds, rectangles or other geometric shapes.

As shown in FIGS. 2 and 3, bottle 10 includes one or more reinforcing elements 100. Each reinforcing element may be in the form of a rib, or a column 102 that protrudes outwardly away from the remaining portions of the bottle 10. In the embodiment shown in FIGS. 2 and 3, the bottle 10 includes one column 102 on each of the shorter and longer sides of the top portion 45. Preferably, each column is centered on each of the shorter and longer sides of bottle 10. In addition, at least one and preferably all corners of the bottle 10 may include a column, as best shown in the cross-sectional view in FIG. 6. The reinforcement elements on adjacent corners curve and/or converge towards one another in a direction oriented towards a neck of the top portion.

As best shown in FIG. 3, each column 102 has sides 104 that are generally curved or crescent shaped, such that the column has a narrow waist portion 106 and flared top 108 and/or bottom portions 110. Each column has a length of about 0.5 to 1.2 inches (about 12 to 30 mm), or about 0.710" (about 18 mm), about 0.3 to 0.8" (about 7 to 20 mm), or about 0.585" (about 15 mm) wide at the center tapering out to about 0.6 to 1.1" (about 15 to 28 mm), or about 0.875" (about 22 mm) as it blends into the geometry of the bottle on the top and bottom of the column.

In an alternative, each column 102 can also have a generally linear profile, with linear sides, or the column can be tapered, where it is wide at the upper or lower end and narrows towards the other end. Each column 102 is associated with lateral transition portions 112 that join the column 102, which protrudes, to the adjacent lateral surfaces 114 of the bottle 10. Surfaces 114 are recessed in comparison to the protruding columns 102.

Figure 6:
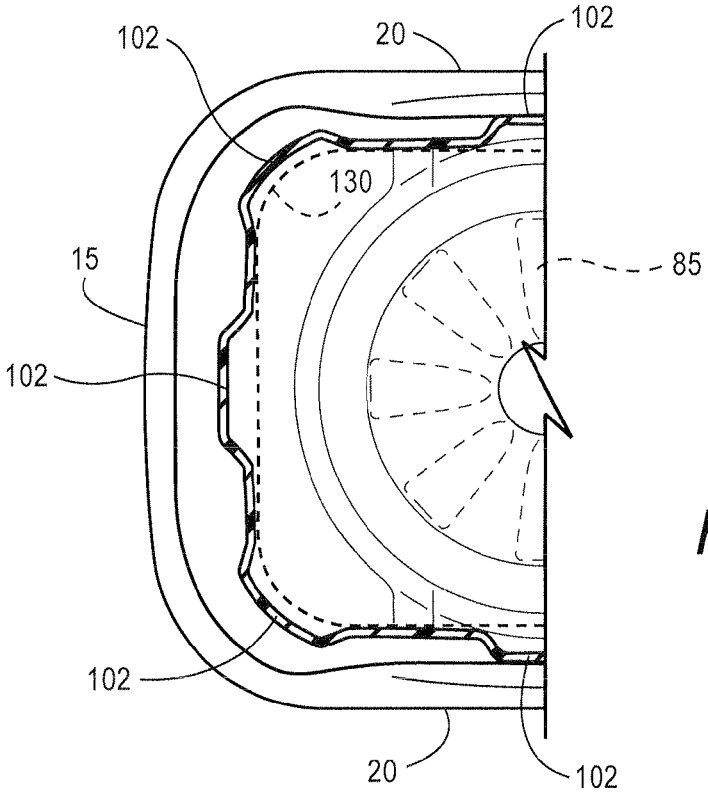
FIG. 6 is a cross sectional view taken along line 6-6 in FIG. 2.

FIG. 6 is a cross-sectional view taken along line 6-6 of FIG. 2, showing half of the bottle 10. A dotted line 130 represents the corresponding cross section in the prior art bottle of FIG. 1. The depth of each column, or the amount is protrudes from the dotted line 130, is about 0.080" (about 2 mm). This and the other dimensions of the column can be varied depending on the bottle's configuration and geometry. While the columns on the corners are generally rounded, the columns on each side are slightly generally planar in the horizontal plane. Each column in the corners has a radius of curvature that is less than about 6 to 10 mm, and preferably is less than about 12 mm, for a rectangular bottle. As shown in FIGS. 2 and 3, the columns may be slightly concave or planar in the vertical plane.

Moreover, while the bottle shown in FIGS. 2-6 includes 8 columns, it is possible to have more or less, depending on application. However, it is preferable that the number of columns be balanced so that the stability and top loading capacity remains evenly distributed, e.g., the strengthening elements should be symmetrically positioned, although they could be asymmetrically oriented and still maintain even load distribution characteristics. In one embodiment, the bottle could have from as few as 2 columns on opposite sides to as many as 14 or more (provided that they are thinner—0.125" (about 3.2 mm) wide at the center). Each column/element should preferably blend in with the bottles general geometry.

The column thickness (depth) could range from the preferred thickness (0.080" (about 2 mm)) to a range of 0.010" up to 0.250" (about 0.25 to 6.4 mm). Again this could be larger or smaller than the exemplary 64 oz. bottle, depending on the geometry, e.g. for bottles with larger or smaller liquid volume capacities, e.g., 4 oz to 8 oz or gallon, etc.

The reinforcing elements 100 are preferably provided in the top portion 45 of the bottle 10, where the "bell" section is located. Specifically, the top portion 45 includes an upper bell portion that generally coincides with the shoulder 60 in FIG. 1, and a lower bell portion 60.1. The reinforcing elements 100 are positioned generally between the upper and lower bell portions 60, 60.1, and can be thought of as a bridge spanning at least a portion of if not the entire valley (or bell waist) which is between the upper and lower bell portions. Each element 100 can bridge or connect the peaks of each bell portion, or the bridge can connect the bell portions along intermediate portions of the adjacent walls that form the valley/waist between the peaks of the bell portions. For example, the elements 100 can extend from the mid section 118 of a wall forming a lower portion of the upper bell portion 60 to the mid section 120 of a wall forming the upper portion of the lower bell portion 60.1. The elements 100 can extend above and or below the peaks of the bell portions as well. Moreover, the elements can be positioned in other locations on the bottle as well. Further, the elements 100 on the longer side of the bottle define a surface 122 that may be coplanar or in a plane that is parallel to the plane defined by the surfaces 124 of the grip portions 65. See e. g., FIG. 3.

Where the top portion 45 includes only the upper bell or shoulder portion 60, the reinforcing element 100 can be positioned between the grip portion 65 and the upper bell or shoulder portion 60. The reinforcing elements 100 could also be positioned anywhere below the shoulder portion 60, including below the grip portion 65.

The top loading capacity of the overall container ranges from about 50-150 lbs, and preferably the range is between about 75-125 lbs., and most preferably about 100 lbs. This is an advantage from the standpoint of shipping. Due to the increased top loading capacity, it is possible to eliminate or reduce the amount of corrugate that is placed between layers of bottles to be shipped. In addition, the increased top loading capacity adds stability to the bottle during the bottling/packing/labeling process, such that placement of labels can be more accurately registered.

Figure 4:
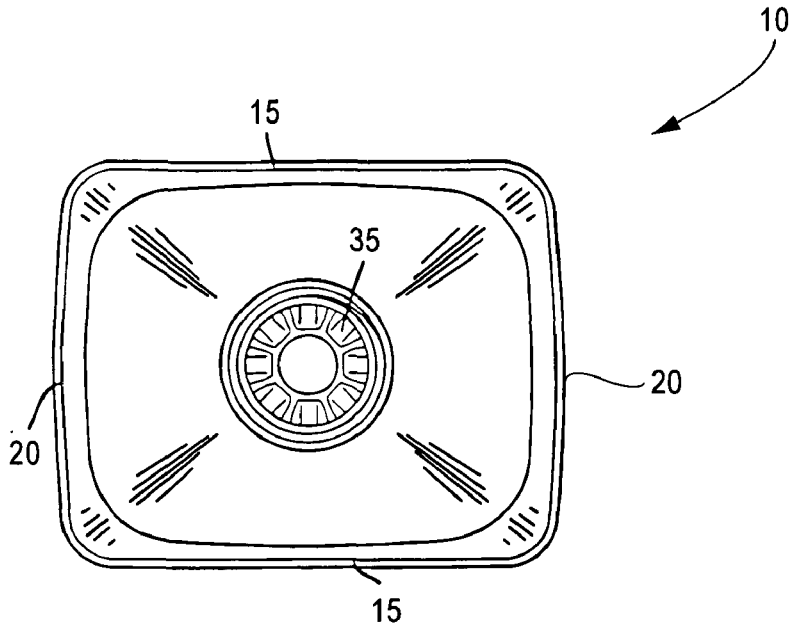
FIG. 4 is a top view of the bottle shown in FIG. 2.
Figure 5:
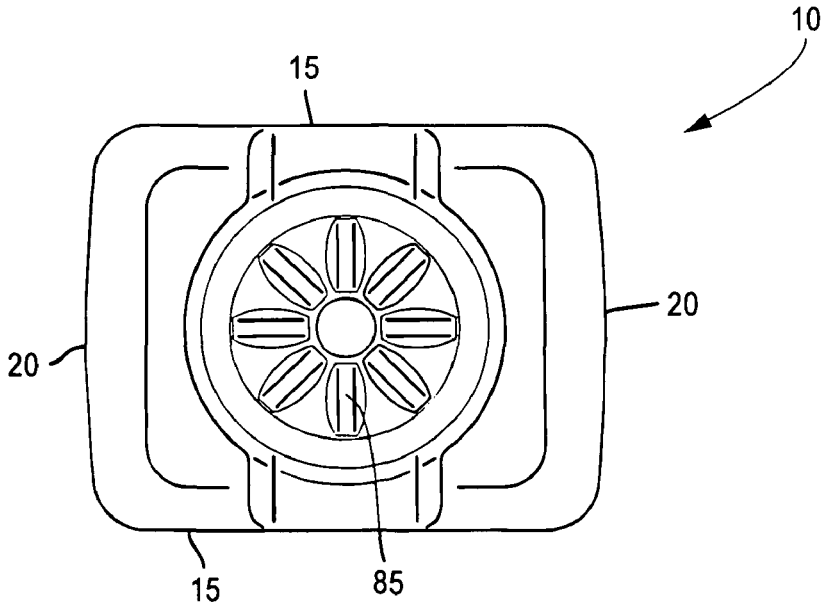
FIG. 5 is the bottom view of the bottle shown in FIG. 2.
Figure 8:
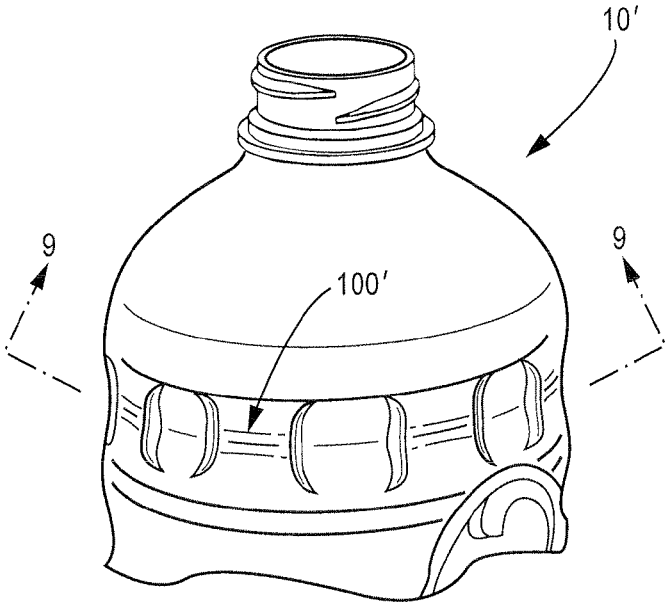
FIG. 8 is a perspective view of a round bottle according to an alternative embodiment of the present invention.
Figure 9:
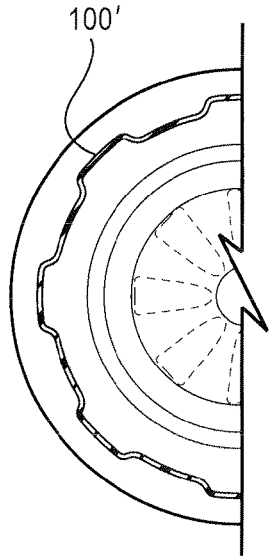
FIG. 9 is a cross-sectional view taken along line 9-9 of FIG. 8.
Figure 7:
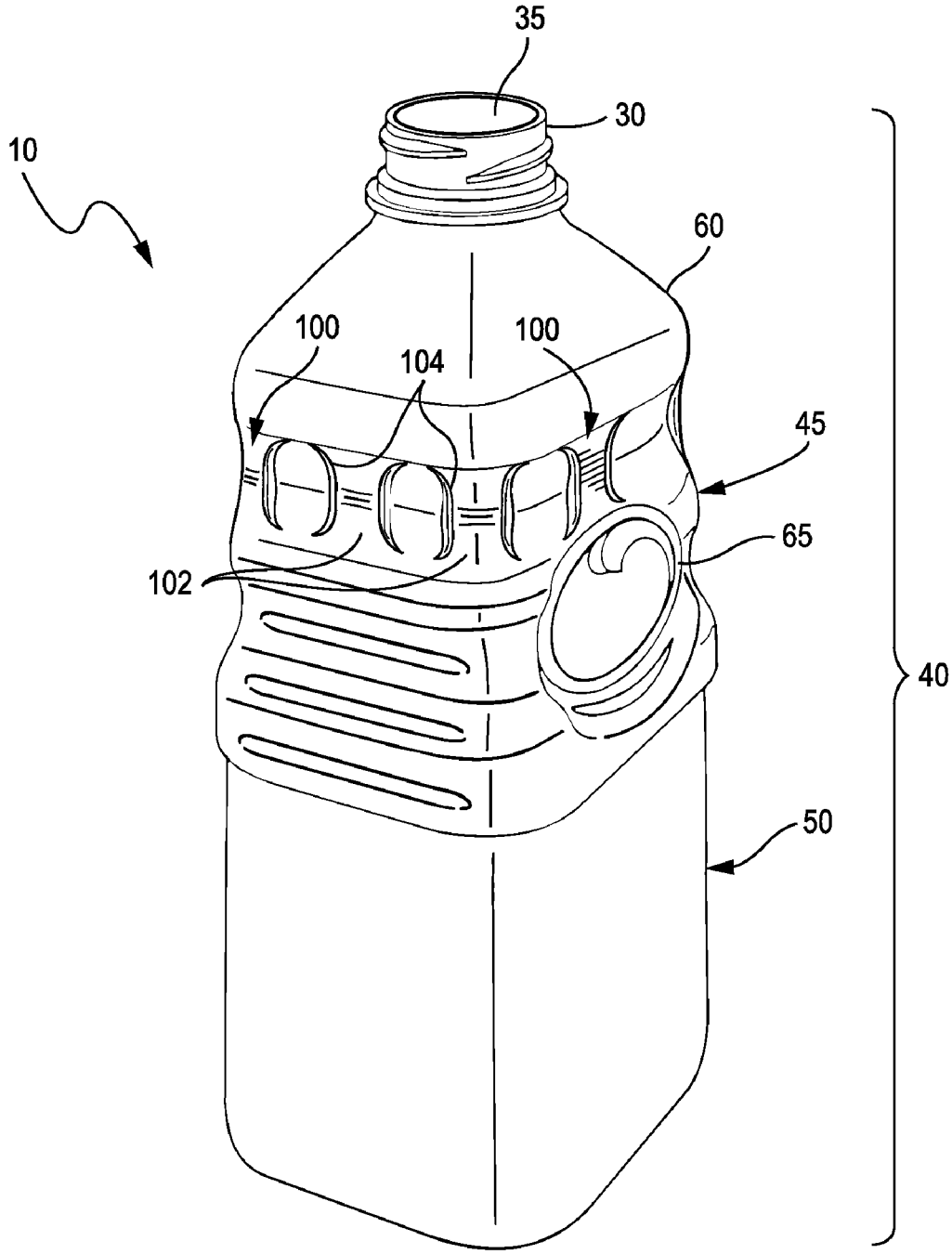
FIG. 7 is a perspective view of the bottle shown in FIG. 2.

Bottle 10 may have overall dimensions as described in U.S. Pat. Nos. 6,575,321 and 6,749,075, each incorporated herein by reference in its entirety. The dimensions of the bottle were selected to conveniently and efficiently fit on the shelves of a supermarket, in a space conserving manner. As shown in FIGS. 4 and 5, bottle 10 is substantially rectangular, for example, and includes longer sides 15 each having a width of about, e.g., 115 millimeters, and shorter sides 20 having a width of about, e.g., 90 millimeters. The dimensions bottle 10 can fit within the door shelf of a refrigerator. A base portion 25 (best shown in FIG. 2) of the container 10 has a width that is slightly greater than the widths of the sides 15, 20 of the container 10. Provisional Application Ser. No. 60/262,641, incorporated herein by reference, shows additional exemplary dimensions of bottle 10. In this particular embodiment, bottle 10 has a volume capacity of about 64 oz. Those of ordinary skill in the art would appreciate that aspects of the present invention are applicable to other containers, such as round or polygon shaped, e.g., square, pentagon, hexagon, septagon, octagon, etc., bottles, which may have different dimensions and volume capacities. FIG. 8 shows a round bottle 10' with reinforcing elements 100', e.g. columns. FIG. 9 is a cross section taken along section 9-9 of FIG. 8. It is also contemplated that other modifications can be made depending on the specific application and environmental requirements.

The grip portion 65 has a height that is about one quarter to about one half, and preferably one third, of a height of the top portion 45 of the body portion 40. The grip portion 65 is adapted to be grasped by the fingers and thumb of a person of average size, for example, an average woman having a size 7 hand. For example, as shown in FIG. 3, the distance between the grip portions 65 is about 83 mm or less, although the distance can range from about 75 to about 90 mm or more. However, the grip portion 65 is not limited for use by a person having average size hands. In this context, the width of the grip portion 65 is designed to be about 50-90% of the width of the container side wall on which it is placed. Preferably, the width is 60-80% (or more or less), and most preferably the width is about 70% of the width of the side wall. By selecting and structuring the height, width and depth of the grip portions 65 using the above dimensions, user comfort is enhanced, a good hand-fit is achieved, and the grip portions 65 can be manipulated by a persons having a wide variety of hand sizes.

The grip portion 65 is provided near the center of gravity of the container 10, as described in U.S. Pat. Nos. 6,575,321 and 6,749,075. Thus, positioning of the grip portions 65 facilitates holding of and pouring liquid contents from the container 10.

Further, the grip portion 65 may also serve as a logo/label portion 70. As shown, each grip portion 65, may include a logo, such as "Ocean Spray®" and/or the Ocean Spray® "wave". The logo may include an anti-slip surface in the form of raised or embossed (depressed) lettering, logos, characters or other designs, which helps prevent the container 10 from slipping out of the user's fingers and thumb. Further, in addition to or instead of using integrally formed lettering, designs or logos, the logo may be in the form of a label that is applied, e.g., using an adhesive, to the grip portion 65. Stated differently, the grip portion 65 may also form an auxiliary label portion, which may be coordinated with the wrap-around label provided on the bottom portion of the container 10. If an integrally formed logo is used with the label, then it is recommended that the integral logo be embossed into the grip portion, rather than being raised, so as to present a more flat surface to which the label may be secured. Because of the increased size of the grip portion, the logo can be more prominently displayed on the bottle 10.

Because of the relatively large size of the logo, the top portion 45 of the bottle 10 can be longer than the bottom portion 50 of bottle 10, where the vacuum panels 55 are positioned. Thus, the vacuum panels 55 may not be sufficient to compensate for the amount of internal vacuum forces that tend to collapse the vacuum panels 55 during the hot-fill process. As such, other portions of the container, such as the base 25 or the top portion 45 of the container, e.g., grip portion 65, may be designed to act as an auxiliary vacuum portion or panel by flexing inwardly during cooling and volumetric shrinkage to accommodate some or all additional internal vacuum forces that are not accommodated by the vacuum panels 55 in the bottom portion 50 of the container 10.

The grip portion 65 is positioned, e.g., along the longer sides 15 of bottle 10. The shorter sides 20 of bottle 10 include a waist portion 75 that is positioned laterally adjacent the grip portion 65 and logo/label portion 70. Each of the shorter sides 20 may include at least one lateral stiffening rib 80 positioned within the waist portion 75. The rib 80 serves to prevent excessive deformation of the auxiliary vacuum panel during the hot-fill process. The rib 80 is configured slightly differently than the ribs 56.

The base portion 25 of the container 10 has a dome-shaped portion 85 which increases strength of the container 10 and facilitates the manufacturing process. The configuration and shape of the dome-shaped portion 85 may also help assist in the on for internal forces created during the hot-fill process, as is known in the art.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention. For example, while an exemplary hot-fillable container has been described, the disclosure is not limited to such and non-hot-fillable containers are also possible in which event vacuum panels would not be required. In addition, while PET containers made using a blow-molding process have been described, other materials and manufacturing processes are also possible. For example, the container can be made using extrusion molding or other stretch molding techniques, and the container could be made from materials such as, for example, polypropylene, high density polypropylene, polyolefin, styrene and other similar plastic materials.

The invention claimed is:

1. A plastic bottle, comprising:

a body portion having a top portion and a bottom portion, the top portion including a shoulder, a grip portion below the shoulder and at least one reinforcing element positioned between the shoulder and the grip portion;

wherein a cross-sectional shape of the body portion and a base portion is substantially rectangular along substantially an entire axial extent thereof, wherein said top portion, as seen in cross section, includes rounded corners, wherein at least one reinforcement element is provided along each rounded corner of the top portion, wherein the reinforcement elements on adjacent corners converge towards one another in a direction oriented towards a neck of the top portion.

2. The bottle according to claim 1, wherein each said reinforcing element comprises a column.

3. The bottle according to claim 2, wherein the column has a length and a narrow middle section that transitions to relatively wider upper and/or lower portions.

4. The bottle according to claim 3, wherein the length is about 0.5 to 1.2 inches, the narrow middle section has a width of about 0.3 to 0.8 inches, and the upper and/or lower portions have a width of about 0.6 to 1.1 inches.

5. The bottle according to claim 4, wherein the length is about 0.710 inches, the width of the narrow section is about 0.585 inches, and the width of the upper and/or lower portions is about 0.875 inches.

6. The bottle according to claim 2, wherein the column protrudes a distance away from the top portion in the range of about 0.010 to 0.250 inches.

7. The bottle according to claim 6, wherein the distance is about 0.080 inches.

8. The bottle according to claim 2, wherein the bottle includes one said column centered on each side of the top portion.

9. The bottle according to claim 1, wherein the bottle has a top loading capacity of about 50 to 150 lbs.

10. The bottle according to claim 9, wherein the capacity is about 100 lbs.

11. The bottle according to claim 1, wherein the top portion includes a bell section including an upper bell portion generally coincident with the shoulder and a lower bell portion, the upper and lower bell portions defining a valley therebetween, the reinforcing element extending across at least a portion of the valley from the upper bell portion to the lower bell portion.

12. The bottle according to claim 1, wherein:

the grip portion is inwardly recessed into the body portion and a ledge is provided along at least one lateral extreme of the grip portion due to inward recessing of the grip portion, wherein the ledge connects the recessed grip portion with non-recessed wall portions of the top portion of the body portion adjacent the grip portion, the grip portion defining at least one first vacuum panel, and the bottom portion includes a plurality of second vacuum panels and a base portion below the plurality of second vacuum panels, each of said plurality of said vacuum panels having a deformation capability that is different than a deformation capability of the at least one first vacuum panel.

13. The bottle according to claim 12, further comprising a plurality of lateral ribs positioned within each of the second vacuum panels.

14. The bottle according to claim 12, further comprising at least one lateral rib provided on the top portion of the body portion and laterally adjacent the at least one first vacuum panel.

15. The bottle according to claim 12, wherein the deformation capability of the at least one first vacuum panel is less than the deformation capability of each of the second vacuum panels.

16. The bottle according to claim 12, wherein the bottle is substantially rectangular and defines two longer sides and two shorter sides, each of the longer sides having said at least one first vacuum panel, and each of the shorter sides including at least one horizontal rib provided on the upper portion of the body portion and laterally adjacent each said at least one first vacuum panel.

17. The bottle according to claim 12, further comprising a waist portion that extends into the body portion, the grip portion and the at least one first vacuum panel being provided laterally adjacent the waist portion.

18. The bottle according to claim 17, further comprising at least one lateral rib provided in the waist portion.

19. The bottle according to claim 12, wherein the at least one first vacuum panel provided in the grip portion defines an integral logo portion having a logo.

20. The bottle according to claim 19, wherein the logo includes raised lettering that serves as an anti-slip surface.

21. The bottle according to claim 19, wherein the logo portion has a height that is about one quarter to about one-half of a height of the top portion.

22. The bottle according to claim 12, wherein the ledge substantially circumscribes the grip portion.

23. The bottle according to claim 1, wherein the bottom portion includes a wrap-around label.

24. The bottle according to claim 1, wherein the grip portion defines a logo portion adapted to receive an auxiliary label.

25. The bottle according to claim 1, wherein a center of gravity of the bottle is positioned in a region of the body portion spanning a transition between the top and the bottom portions.

26. The bottle according to claim 1, wherein the bottle is hot-fillable.

27. The bottle according to claim 1, wherein the bottle is cold-fillable.

28. The bottle according to claim 1, wherein the reinforcement elements on adjacent corners curve towards one another.

* * * * *